US008628031B2

(12) United States Patent
Kiss

(10) Patent No.: US 8,628,031 B2
(45) Date of Patent: Jan. 14, 2014

(54) METHOD AND APPARATUS FOR CONTROLLING NEEDLE SEAT LOAD IN VERY HIGH PRESSURE DIESEL INJECTORS

(75) Inventor: Tibor Kiss, Manitou Springs, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 398 days.

(21) Appl. No.: 12/986,386

(22) Filed: Jan. 7, 2011

(65) Prior Publication Data

US 2011/0163177 A1 Jul. 7, 2011

Related U.S. Application Data

(60) Provisional application No. 61/293,110, filed on Jan. 7, 2010.

(51) Int. Cl.

| | |
|---|---|
| ***F02M 57/02*** | (2006.01) |
| ***F02M 63/00*** | (2006.01) |
| ***F02M 47/02*** | (2006.01) |
| ***F02M 61/20*** | (2006.01) |

(52) U.S. Cl.
USPC ..... 239/533.8; 239/5; 239/533.5; 239/533.9; 123/446; 123/447

(58) Field of Classification Search
USPC ..... 239/5, 533.1, 533.2, 533.5, 533.8, 239/533.9; 123/299, 446, 447, 467, 468
See application file for complete search history.

(56) References Cited

U.S. PATENT DOCUMENTS

| | | | | |
|---|---|---|---|---|
| 6,758,417 | B2 * | 7/2004 | Buck | 239/533.2 |
| 6,976,474 | B1 * | 12/2005 | Coldren et al. | 123/446 |
| 2008/0149741 | A1 * | 6/2008 | Remmelgas | 239/89 |
| 2008/0277504 | A1 * | 11/2008 | Sturman | 239/533.3 |

* cited by examiner

*Primary Examiner* — Justin Jonaitis
(74) *Attorney, Agent, or Firm* — Blakely Sokoloff Taylor & Zafman LLP

(57) ABSTRACT

Method and apparatus for controlling needle seat load in very high pressure diesel injectors. In accordance with the method, a needle control piston responsive to hydraulic forces for controllably forcing the injector needle against the needle seat is provided, as is a stop for the needle control piston to limit the needle control piston movement toward the needle seat. This provides a stop for the needle control piston, so that the compressive deflection between the needle control piston and the needle seat limits the force of the injector needle on the needle seat against increasing hydraulic forces on the needle control piston once the needle control piston reaches the needle control piston seat.

5 Claims, 2 Drawing Sheets

Current Art Injector

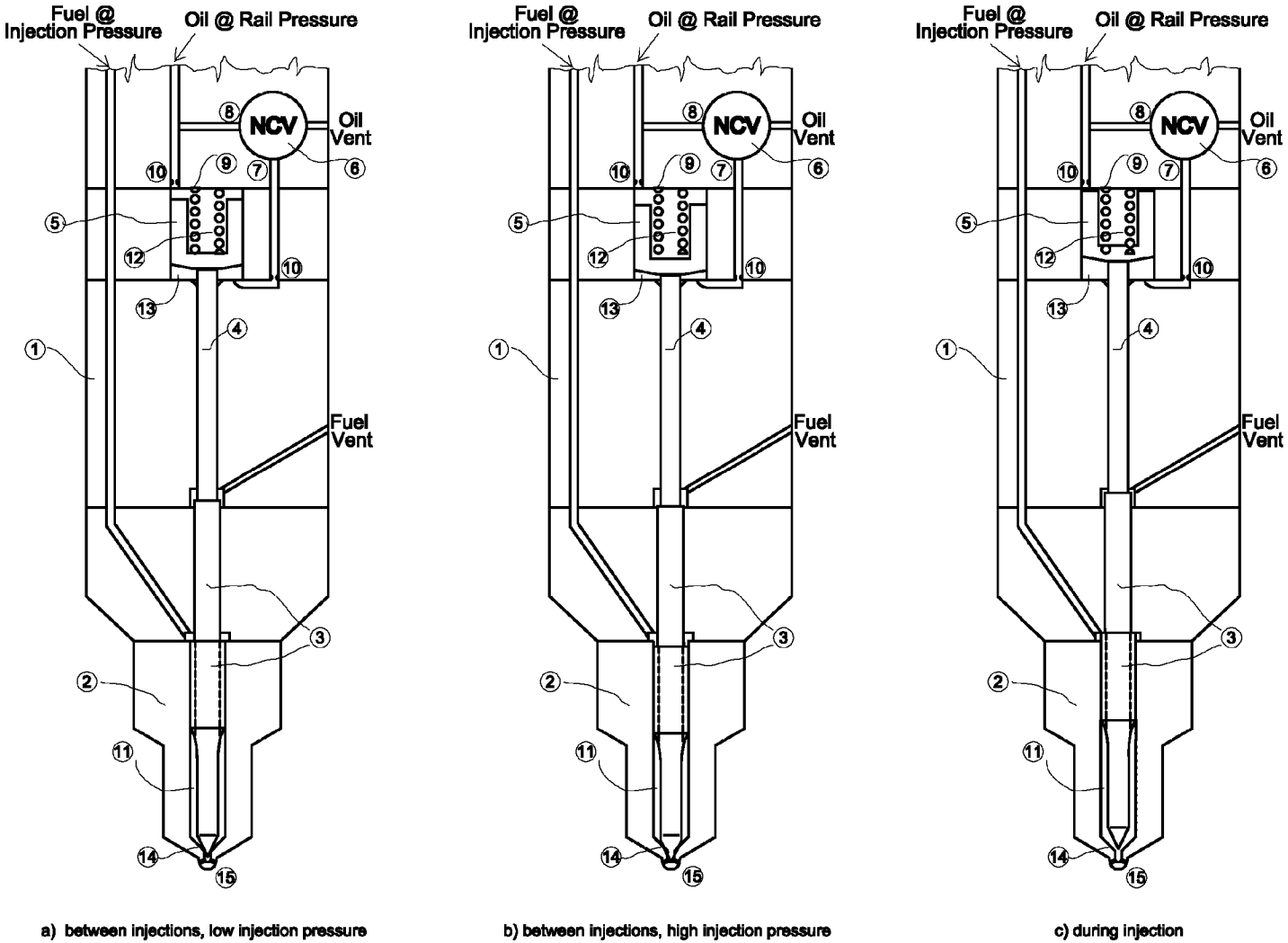
a) between injections, low injection pressure
b) between injections, high injection pressure
c) during injection
Figure 1. Current Art Injector

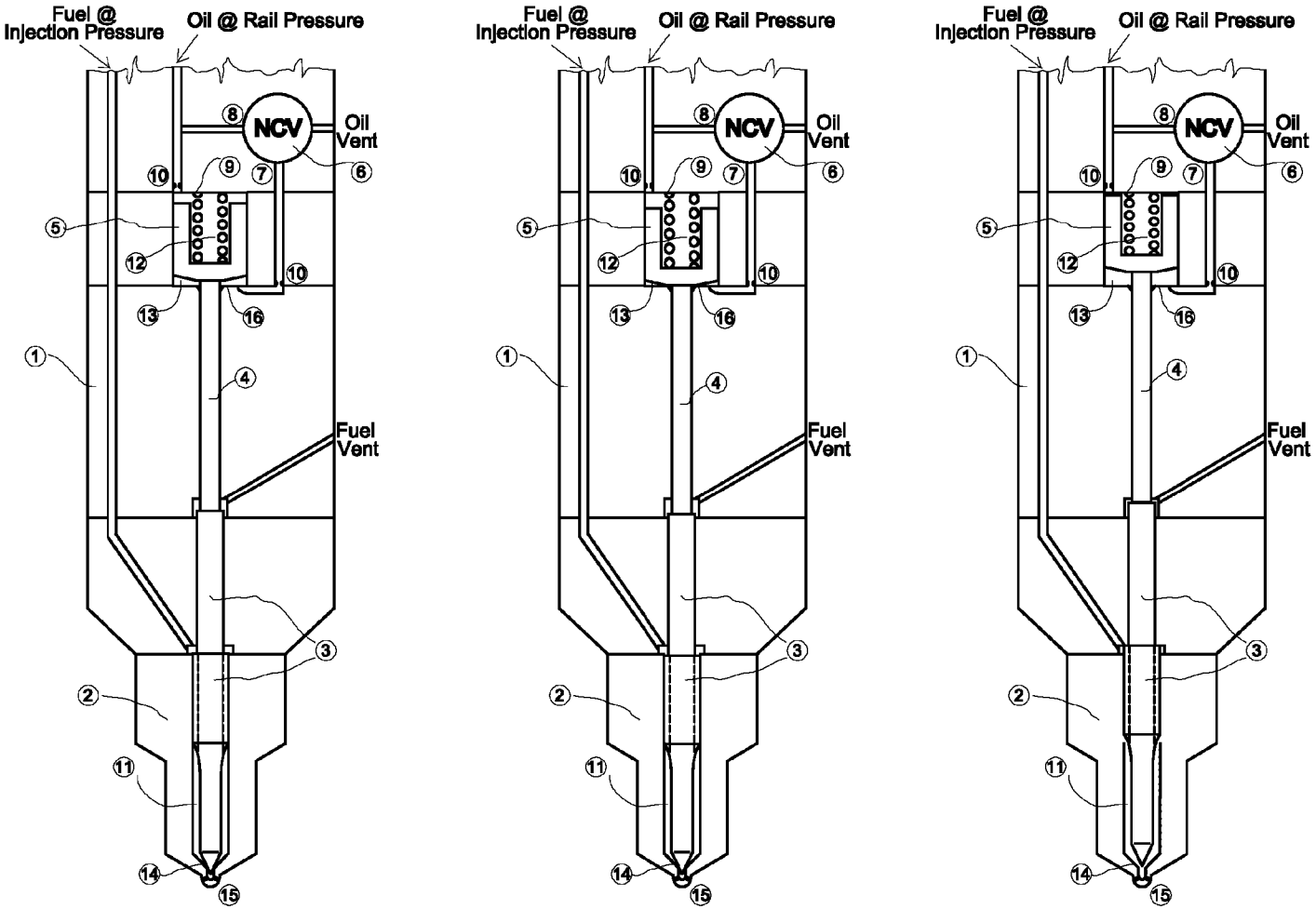
a) between injections, low injection pressure
b) between injections, high injection pressure
c) during injection
Figure 2. The invented New Injector

METHOD AND APPARATUS FOR CONTROLLING NEEDLE SEAT LOAD IN VERY HIGH PRESSURE DIESEL INJECTORS

CROSS-REFERENCE TO RELATED APPLICATIONS

This application claims the benefit of U.S. Provisional Patent Application No. 61/293,110 filed Jan. 7, 2010.

BACKGROUND OF THE INVENTION

1. Field of the Invention

The present invention relates to the field of very high pressure diesel fuel injectors.

2. Prior Art

This invention relates to high pressure diesel fuel injectors in which the injector needle valve opening and closing is controlled by a control piston, and in which in the closed needle valve position the high pressure hydraulic fluid (fuel or oil) above the control piston provides the force that crushes the needle valve in its seat to seal the fuel from entering the combustion chamber when injection is not required.

FIG. 1(*a*) shows a current art injector between injection events for low injection pressures, FIG. 1(*b*) shows the current art injector between injection events for high injection pressures, and FIG. 1(*c*) shows the current art injector during injection events. The current art lower injector consists of a housing (1) which in practice consists of several smaller pieces not detailed in the figures, a nozzle (2), a needle (3), a transfer pin (4), a control piston (5) and a needle control valve or NCV (6). The NCV (6) is a three-way two-position electromagnetically actuated hydraulic control valve, which connects the control port (7) to the oil vent when off and connects the supply port (8) to control port (7) when on. A needle control spring (9) and control orifices (10) also may or may not be present. The fuel at the injection pressure is directly fed into the needle volume (11). The oil at rail pressure is directly fed to the hydraulic volume above the control piston (5) which hydraulic volume is called the balance volume (12). The oil at rail pressure is also directly fed to the NCV supply port (8). The NCV control port (7) is connected to the hydraulic volume below the control piston (5) which hydraulic volume is called the control volume (13). Between injection events, the NCV (6) is in the off position, and the control volume (13) is connected to the oil vent, and therefore is at oil vent pressure. The balance volume (12) is always near the oil rail pressure. Therefore, between injection events there is a large downward resultant force on the control piston (5). The diameter of the control piston (5) is chosen such that this resultant force is larger than the upward pressure force on the needle (3), therefore the control piston resultant force crushes the needle (3) into needle seat (14), thereby sealing the fuel from entering the combustion chamber (15). Since the injection pressure and the oil rail pressure are always proportional, all the forces on the needle/transfer pin/control pin stack (except for the nearly negligible control spring force) are proportional to the injection pressure. Then, it can be easily seen that the needle seat load (the mechanical load between the needle (3) and the needle seat (14)) is proportional to the injection pressure (and consequently, to the oil rail pressure).

The proportionality of the needle seat load to the injection pressure is a problem for the current art injectors in applications with very high injection pressure. This is because a minimum needle seat load has to be maintained at low pressure injection. Then, at very high pressures, the needle seat load becomes so high that maintaining structural integrity becomes a serious challenge. Also, the resulting high needle seat load at high injection pressure is not needed from the functional point of view, as the seat load could be reduced while sealing would still be maintained. From this analysis it is clear that it would be advantageous to modify the current art injectors in a way that reduces the needle seat loads at high injection pressures while maintaining the needle seat loads at low injection pressures.

BRIEF DESCRIPTION OF THE DRAWINGS

FIGS. 1*a*, 1*b* and 1*c* illustrate the lower portion of a prior art injector between injections with a relatively low pressure holding the needle closed, a relatively high pressure holding the needle closed, and during injection, respectively.

FIGS. 2*a*, 2*b* and 2*c* illustrate the lower portion of an injector in accordance with the present invention between injections with a relatively low pressure holding the needle closed, a relatively high pressure holding the needle closed, and during injection, respectively.

DETAILED DESCRIPTION OF THE PREFERRED EMBODIMENTS

It was previously stated that it would be advantageous to modify the current art injector in a way that reduces the needle seat loads at high injection pressures while maintaining the needle seat loads at low injection pressures. Such modification is the subject of the invention disclosed herein.

In the disclosure to follow, only the lower part of the injector will be described. It is assumed that fuel at injection pressure (500-4000 bar range) and oil at rail pressure (30-500 bar range) is available for the lower injector. It is also assumed that these two pressures change within a range, but their ratio stays constant, because—for example—the fuel at injection pressure is generated with a hydraulic intensifier with constant pressure (area) ratio, using the oil at oil rail pressure to power the intensifier.

The invention will be described through the preferred embodiment, but will be extended later for various different configurations. The invention takes advantage of the high compression of the needle/transfer pin/control piston stack in the current art injector. This compression is illustrated in FIG. 1(*b*) where it can be seen that the bottom of the control piston (5) is closer to the control volume (13) lower surface than in FIG. 1(*a*). That is due to the compression of the needle/transfer pin/control piston stack under the very high pressure loads.

The invented lower injector is shown in FIG. (2) for three different conditions. In general the same parts are included in the new injector as in the current art injector, so the names and numbering used in the description of the current art injector apply. In FIG. 2(*a*), the injector is shown between injection events for low injection pressure, in FIG. 2(*b*) it is shown between injection events for high injection pressure, and in FIG. 2(*c*) it is shown during injection events. In the new invention, the proportionality between the injection pressure and the needle seat load is broken by the placement of a stop on the downward motion of the control piston which stop is referred to herein as the control piston seat (16). The injection pressure above which the control piston (5) seats against seat (16) will be referred to in the claims to follow as the threshold injection pressure. In practice the placement of seat (16) just means that the protrusion of the transfer pin (4) above the top of its guide in a de-pressurized (or 'assembled') injector is smaller in the new invention than in the prior art injector. As the injection pressure is rising, the compressive load on the needle/transfer pin/control pin stack is increasing. The compressive force is very high, typically in the several thousand Newton range, and as a result, a significant elastic compression of the needle/transfer pin/control pin stack occurs. When the nominal or 'assembled' distance between the lower surface of the control piston (5) and the control piston seat (16) is small enough, then at high pressure the control piston (5) comes into contact with the control piston seat (16). The stiffness of the control piston seat (16) is very high, and therefore once such contact is established and the injection pressure is further increased, the needle seat load does not increase any further. Instead, as a first approximation, the load on the control piston seat (16) increases, and the sum of the control piston seat load and the needle seat load is equal to what the needle seat load would be had the control piston seat not been installed. Thereby, the needle seat load is limited, and the structural challenges on needle/nozzle design are mitigated.

The compression of the needle/transfer pin/control piston stack in the current art injector in general is not preferable because it leads to an increase of the hydraulic delay, defined by the time between commanding injection and the start of injection (there is also some extension of the parts that are in tension by the needle force on the needle seat, particularly the needle chamber, though this is normally very small and can be considered a second order effect, as is the expansion of the needle chamber due to increasing injection pressures, though these effects may be included in determining the position of the needle seat, if desired). In certain injectors, where the needle/transfer pin/control pin stack is long, the hydraulic delay can get quite substantial. The current invention turns a generally disadvantageous behavior into an advantage: the large compression allows accurate control of the injection pressure at which the control piston (5) comes into contact with the control piston seat (16) (the 'threshold injection pressure') and partially unloads the needle (3) and needle seat. At the same time, hydraulic delay is also reduced.

This invention can be extended to still other geometries somewhat different from the one described above. For example, it is a special case when fuel is used in the oil rail for the needle control. Also, as a special case, injection pressure and rail pressure can always be equal—which would be the case if no intensifier was used and fuel from the same high pressure rail was used to feed the nozzle and the needle control hydraulic circuit. In this case, the pressure operating the needle control piston is still proportional to the injection pressure, that proportion be 1 to 1. Furthermore, other functional features may be present in the injector, such as a large hydraulic accumulator inside the injector housing (1) directly connected to the needle volume (11), together with a check valve to maintain the intensified pressure while the intensifier plunger chamber refills. The invention may also be applied to multiple intensifier injectors, and injectors having one intensifier plunger and multiple intensifier pistons, wherein the intensifier plunger may be powered by all or subcombinations of the intensifier pistons to be able to obtain multiple intensified fuel pressures from a single intensifier actuation fluid pressure. Finally, the concept can also be used for a direct needle control injector in which the hydraulic volume on top of the control piston (5) is connected to the control port (7) of the NCV (6) and the hydraulic volume on the bottom of the control piston is connected to vent.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A fuel injector comprising:

a source of fluid under pressure proportional to a fuel injection pressure;

a needle in a needle chamber moveable between a first needle position engaging a needle seat and a second needle position spaced away from the needle seat;

a needle control piston moveable between a first needle control piston position in contact with a needle control piston seat and a second needle control piston position displaced from the needle control piston seat;

a linkage between the needle and the needle control piston, the needle reaching the first needle position before the control piston reaches the first control piston position;

a needle control valve coupled to the source of fluid under pressure, to a vent and to a first side of the needle control piston;

the needle control valve controlling the difference in the fluid pressure between a first and a second side of the needle control piston to controllably force the needle control piston toward the needle control piston seat with a force proportional to the fuel injection pressure when the fluid pressure on the first side of the needle control piston is higher than the fluid pressure on the second side of the needle control piston;

the needle control piston, responsive to the control valve, being in an intermediate position between the first and second needle control piston position pushing the needle against the needle seat through the linkage with a force proportional to the fuel injection pressure when the fuel injection pressure is below a threshold injection pressure, and the needle control piston being in the first needle piston position pushing the needle against the needle seat through the linkage with a force not rising with injection pressure for fuel injection pressures above the threshold injection pressure, the force not rising because of the limitation on the compression of the linkage caused by the limitation of the movement of the control piston beyond the first position.

2. The fuel injector of claim 1 wherein the fluid under pressure is coupled to the first side of the needle control piston to force the needle control piston toward the needle control piston seat, and the needle control valve controls the fluid pressure on the second side of the needle control piston to controllably balance or unbalance pressure forces on the first and second sides of the needle control piston.

3. A method of limiting the force of an injector needle against a needle seat in a fuel injector comprising:

providing a needle control piston responsive to hydraulic forces for controllably forcing the injector needle against the needle seat; and providing a stop for the needle control piston to limit the needle control piston movement toward the needle seat once the needle contacts the needle seat;

the compressive deflection between the needle control piston and the needle seat limiting the force of the injector needle on the needle seat against increasing hydraulic forces on the needle control piston once the needle control piston reaches the needle control piston stop.

4. The method of claim 3 wherein the hydraulic forces are provided by oil.

5. The method of claim 3 wherein the hydraulic forces are provided by fuel.

* * * * *